US005779077A

United States Patent [19]

Fossey

[11] Patent Number: 5,779,077

[45] Date of Patent: Jul. 14, 1998

[54] CONTAINER TANK

[75] Inventor: Robin Ernest Fossey, Redhills, Ireland

[73] Assignee: Container Design Limited, County Monaghan, Ireland

[21] Appl. No.: 553,311

[22] PCT Filed: May 23, 1994

[86] PCT No.: PCT/IE94/00030

§ 371 Date: Feb. 12, 1996

§ 102(e) Date: Feb. 12, 1996

[87] PCT Pub. No.: WO94/27893

PCT Pub. Date: Dec. 8, 1994

[30] Foreign Application Priority Data

May 21, 1993 [IE] Ireland ..... S930385

[51] Int. Cl.[6] ..... B65D 88/00

[52] U.S. Cl. ..... 220/1.5

[58] Field of Search ..... 220/1.5

[56] References Cited

U.S. PATENT DOCUMENTS

| | | | |
|---|---|---|---|
| 3,726,481 | 4/1973 | Botkin | 220/1.5 |
| 3,971,491 | 7/1976 | Mowatt-Larssen | 220/1.5 X |
| 4,412,626 | 11/1983 | Gerhard | 220/1.5 |
| 4,591,064 | 5/1986 | Gerhard | 220/1.5 |
| 4,593,832 | 6/1986 | Gerhard | 220/1.5 |
| 4,854,462 | 8/1989 | Gerhard | 220/1.5 X |
| 5,198,398 | 3/1993 | Van Duijn | 220/1.5 X |

FOREIGN PATENT DOCUMENTS

| | | |
|---|---|---|
| 0 425 190 | 5/1991 | European Pat. Off. . |
| 2 137 075 | 12/1972 | France . |
| 2 292 644 | 6/1976 | France . |

*Primary Examiner*—Steven M. Pollard

*Attorney, Agent, or Firm*—Lowe, Price, LeBlanc & Becker

[57] ABSTRACT

A frame type container tank (1) comprises a tank (3) located within the framework (2). Fusto-conical bearer plates (25) mount the tank (3) to end frames (9) of the framework (2) and upper and lower longitudinal members (20, 21) join the end frames (9). Four reinforcing plate members (30) at the four lower corners of the framework (2) each comprise a pair of identical spaced apart parallel reinforcing plates (31) which extend between and are secured to the bearer plates (25) and the lower longitudinal members (21). Reinforcing struts (45) extend between the reinforcing plate members (30) and the lower longitudinal members (21). The provision of the reinforcing plate members (30) in combination with the reinforcing struts (45) provide for significant weight reduction in the framework (2) without loss in carrying capacity of the container tank (1).

19 Claims, 6 Drawing Sheets

CONTAINER TANK

Figure 1:
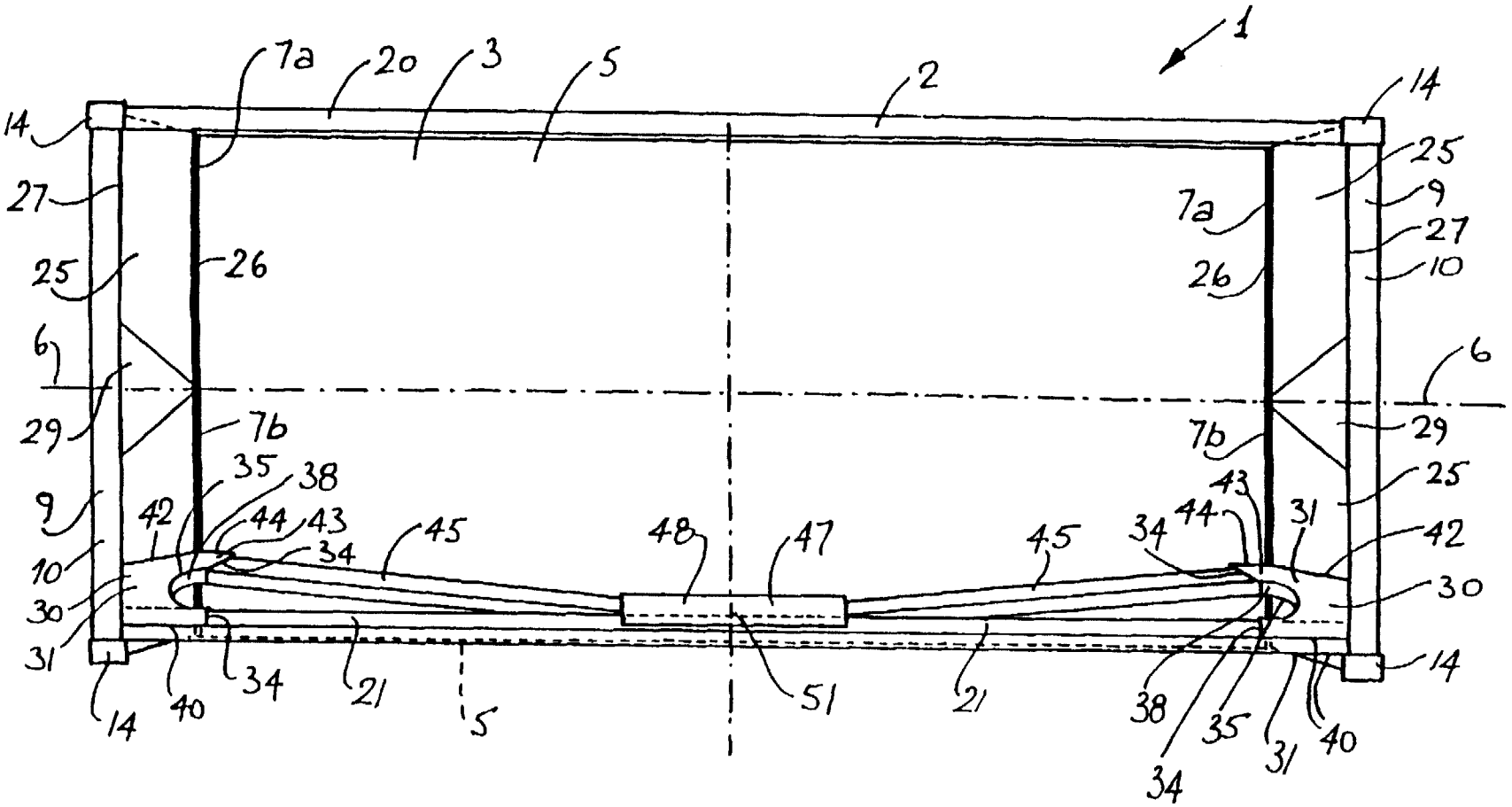

The present invention relates to a container tank of the type suitable for the transportation of liquids, fluids and other materials with fluid like characteristics. In particular, the invention relates to a container tank of the type normally transported on a truck flat, railway wagon, and container ship.

Such container tanks can be broadly categorised into two types, namely, beam tanks and frame tanks. Beam tanks are container tanks in which a tank is located between and secured to a pair of spaced apart end frames located at opposite ends of the tank. In such container tanks, the tank forms an essential structural member of the structure of the container tank, and itself forms a load bearing and load carrying strut. A frame tank comprises a framework and the tank is located within the framework. The framework, in general, comprises a pair of spaced apart end frames joined by a plurality of longitudinally extending members, typically, four longitudinal beams extending between the four opposite corners of the respective end frames. The tank is located within the framework, and is secured to the framework by suitable mountings. In such frame tanks, in general, the tank does not form a structural member of the framework, and where it does, plays a relatively insignificant role in the strength of the framework. Because of the fact that in such frame tanks, the entire load carrying and load bearing capacities must be provided by the framework, the structural members of the framework, and in particular, the longitudinal members extending between the end frames must be of relatively high load bearing and carrying capacity to withstand static stresses which are induced in the framework by its own weight, the weight of the tank and the weight of the contents of the tank, and also to withstand dynamic stresses, which are induced in the framework during transportation. Such dynamic stresses can result from rapid acceleration and deceleration, as well as centrifugal forces resulting from transportation of the tank. Indeed, such dynamic forces may not always act directly longitudinally or transversely of the tank, they may act on the framework at an angle, thus tending to induce buckling stresses and strains in the framework. To provide the necessary load bearing and carrying capacities and to withstand such stresses, in general, the longitudinal members extending between the end frames must be provided by I-beams of relatively large transverse cross section. Such I-beams tend to be relatively heavy, and significantly increase the weight of the framework. In general, container tanks are subject to maximum overall fully laden weights stipulated by road, rail, shipping and other freight transport authorities. Thus, any increase in the weight of the framework for structural purposes or otherwise leads to a reduction in the carrying capacity of the container tank.

There is therefore a need for a container tank of the frame type in which the weight of the framework can be reduced, particularly, by the provision of longitudinal members extending between the end frames of relatively lighter weight than is required in frame tanks known heretofore.

The present invention is directed towards providing such a container tank.

According to the invention, there is provided a container tank comprising an elongated tank defining a longitudinally extending central axis, and defining four quadrants in transverse cross section, namely, a pair of upper quadrants and a pair of lower quadrants, the tank being disposed between a pair of spaced apart end frames extending transversely of the central axis at respective opposite ends of the tank, the end frames being joined by a pair of spaced apart parallel lower longitudinal members extending from positions adjacent respective opposite lower corners of the end frames, and a mounting means at each end of the tank for mounting the tank to the adjacent end frame, wherein each mounting means comprises at least one bearer plate extending from the tank adjacent the lower quadrants thereof to the adjacent end frame, and each bearer plate is secured to the tank and the adjacent end frame, and four reinforcing plate members are located adjacent the four respective lower corners of the end frames, each reinforcing plate member extending between and being secured to the adjacent lower longitudinal member and the bearer plate.

Preferably, each reinforcing plate member is secured to the adjacent end frame. Advantageously, each reinforcing plate member extends from the adjacent bearer plate and is secured to an adjacent portion of the tank.

Ideally, an elongated reinforcing strut is secured to each reinforcing plate member at a position adjacent the bearer plate and spaced apart from the lower longitudinal member, each reinforcing strut extending from the adjacent reinforcing plate member towards the adjacent lower longitudinal member and being secured to the lower longitudinal member at a position spaced apart from the adjacent reinforcing plate member.

In one aspect of the invention, a portion of a peripheral edge of each reinforcing plate member intermediate the adjacent lower longitudinal member and the reinforcing strut defines an arcuate recess, the adjacent lower longitudinal member and reinforcing strut extending from the reinforcing plate member tangentially to the arcuate peripheral edge portion.

Preferably, each reinforcing plate member comprises a pair of spaced apart parallel reinforcing plates, the reinforcing plates of each reinforcing plate member being secured to opposite sides of the adjacent lower longitudinal member. Advantageously, each reinforcing plate is provided with an arcuate peripheral edge portion intermediate the adjacent lower longitudinal member and the adjacent reinforcing strut. Ideally, an arcuate connecting plate extends between the reinforcing plates of each reinforcing plate member adjacent the arcuate peripheral edge portions of the respective reinforcing plates, the connecting plate co-inciding with the arcuate peripheral edge portions.

Each reinforcing plate member defines a central plane parallel to the reinforcing plates the central plane containing the central axis of the tank, and preferably, the central plane of each reinforcing plate member extends downwardly from the central axis of the tank at an angle to the vertical in the range of 30° to 60°. Advantageously, the central plane of each reinforcing plate member extends downwardly from the central axis of the tank at an angle to the vertical of approximately 45°. Ideally, the lower longitudinal member and the reinforcing strut adjacent each reinforcing plate member lie in the central plane of the reinforcing plate member.

It is preferable that the two reinforcing struts adjacent each lower longitudinal member are secured to the lower longitudinal member at spaced apart locations. Preferably, the two respective reinforcing struts extend to and are secured to the lower longitudinal member at locations short of the midway position between the respective ends of the lower longitudinal member. Advantageously, the two respective reinforcing struts are secured to the lower longitudinal member at locations equi-spaced on opposite sides of the midway position. Ideally, the two reinforcing struts adjacent each lower longitudinal member are secured to the lower longitudinal member by an elongated connecting member of U-shaped cross section, the connecting member having a pair of spaced apart side webs extending from a main transverse web, the side webs being secured to the lower longitudinal member and defining with the main web and the lower longitudinal member an elongated bore for receiving the respective reinforcing struts.

In one embodiment of the invention, the tank comprises an elongated central shell defining the central axis, the ends of the central shell being closed by a pair of transversely extending end caps. Preferably, each bearer plate extends from the tank adjacent the central shell. Advantageously, each bearer plate extends from the central shell of the tank adjacent the adjacent end cap thereof.

In another embodiment of the invention, the tank is of circular transverse cross section.

It is preferable that each bearer plate is an arcuate bearer plate, and each bearer plate defines an axis of generation extending generally parallel to the central axis of the tank. Preferably, each bearer plate is formed by portion of a conical wall which diverges away from the tank. Advantageously, the bearer plate at each end of the tank extends completely around the tank and defines an axis of generation co-inciding with the central axis of the tank. Ideally, the curvature of each bearer plate adjacent the tank co-incides with the curvature of the central shell of the tank.

In another embodiment of the invention, each end frame comprises a pair of spaced apart upstanding side members joined by spaced apart top and bottom cross members. Preferably, each bearer plate is secured to the side and top and bottom cross members of the end frame. Preferably, each reinforcing plate member is secured to the adjacent lower longitudinal member of the bearer plate and the reinforcing strut by seam welding, and preferably, each bearer plate is secured to the tank and the end frame by seam welding.

In one aspect of the invention, a pair of spaced apart parallel upper longitudinal members extend from positions adjacent respective opposite upper corners of the end frame for forming with the end frames and the lower longitudinal members a framework within which the tank is located.

The advantages of the invention are many. A particularly important advantage of the invention is that it facilitates the provision of a frame type container tank in which the overall weight of the frame is substantially less than frames of container tanks known heretofore for a similar load carrying and bearing capacity. In particular, the container tank according to the invention is provided with longitudinal members extending between the end frames of cross section considerably less than would be required in a frame type tank known heretofore, and since the cross section of longitudinal members is less than those known heretofore, likewise, the weight of the longitudinal members is likewise less than the weight of longitudinal members required for frame type tanks known heretofore. Accordingly, the invention facilitates the provision of a frame type tank of considerably less weight for the same load bearing and carrying capacity of tanks known heretofore. As well as the load bearing and carrying capacities of the container tank according to the invention being substantially similar to that of known tanks while the overall weight of the frame is significantly reduced, it has also been found that there is a significant improvement in the fatigue characteristics of the tank. In other words, the possibility of failure of the container tank resulting from fatigue is considerably less than would normally be expected. These advantages are largely achieved by the provision of the four reinforcing plate members located adjacent the lower corners of the end frame in combination with the fact that the reinforcing plate members are secured to the bearer plates adjacent the lower quadrants of the tank and to the lower longitudinal members. The provision of reinforcing struts also, it has been found, significantly increases the load carrying and load bearing capacity of the container tank. It has also been found that as well as being able to withstand static loads, the container tank according to the invention is particularly strong and well capable of withstanding dynamic stresses and stains. In particular, the provision of the reinforcing plate members extending between and secured to the bearer plates and the lower longitudinal members considerably strengthens the frame, and in turn, the container tank against buckling which would otherwise result from non-axially applied forces to the framework. Additionally, the provision of the reinforcing struts coupled with the reinforcing plate members substantially eliminates any danger of bowing of the lower longitudinal members, thereby further preventing buckling of the framework of the container tank.

It is believed that these and many other advantages of the container tank of the invention are achieved by virtue of the fact that the tank forms an integral structural load bearing and load carrying member of the framework. This is firstly achieved by virtue of the fact that the tank is secured to the framework by bearer plates extending at opposite ends of the tank to the adjacent end frames. Secondly, by virtue of the fact that the four reinforcing plate members are provided extending between and secured to the lower longitudinal members and the bearer plates, the tank is rigidly secured to and anchored in the framework, and buckling of the framework is resisted.

By virtue of the fact that the bearer plates are of fusto-conical shape, the bearer plates engage the end frames adjacent the periphery of the end frames, thereby enabling the end frames to be provided of lighter weight material without reducing the load bearing and load carrying capacity of the framework and the container tank.

Figure 2:
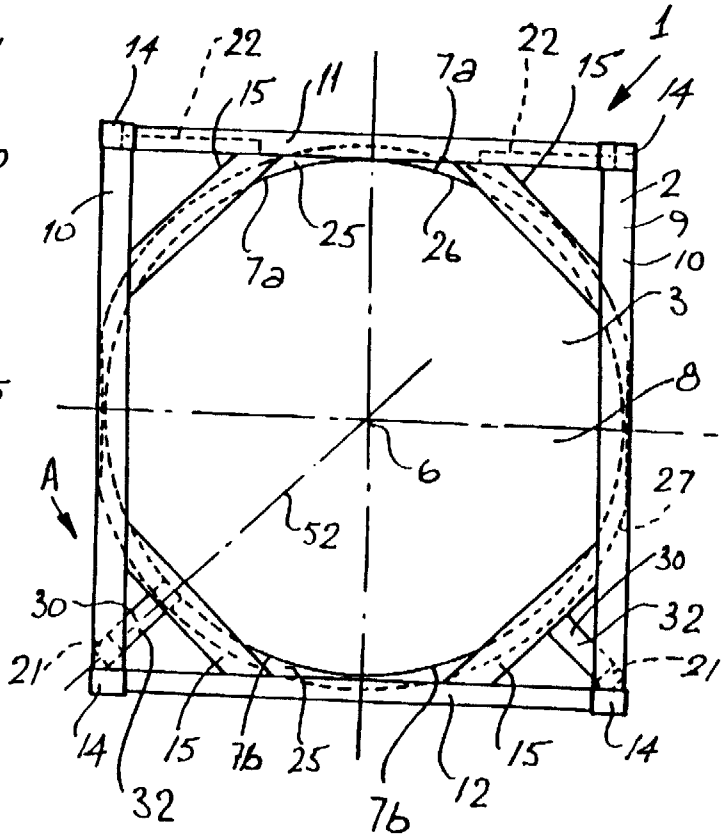
Figure 5:
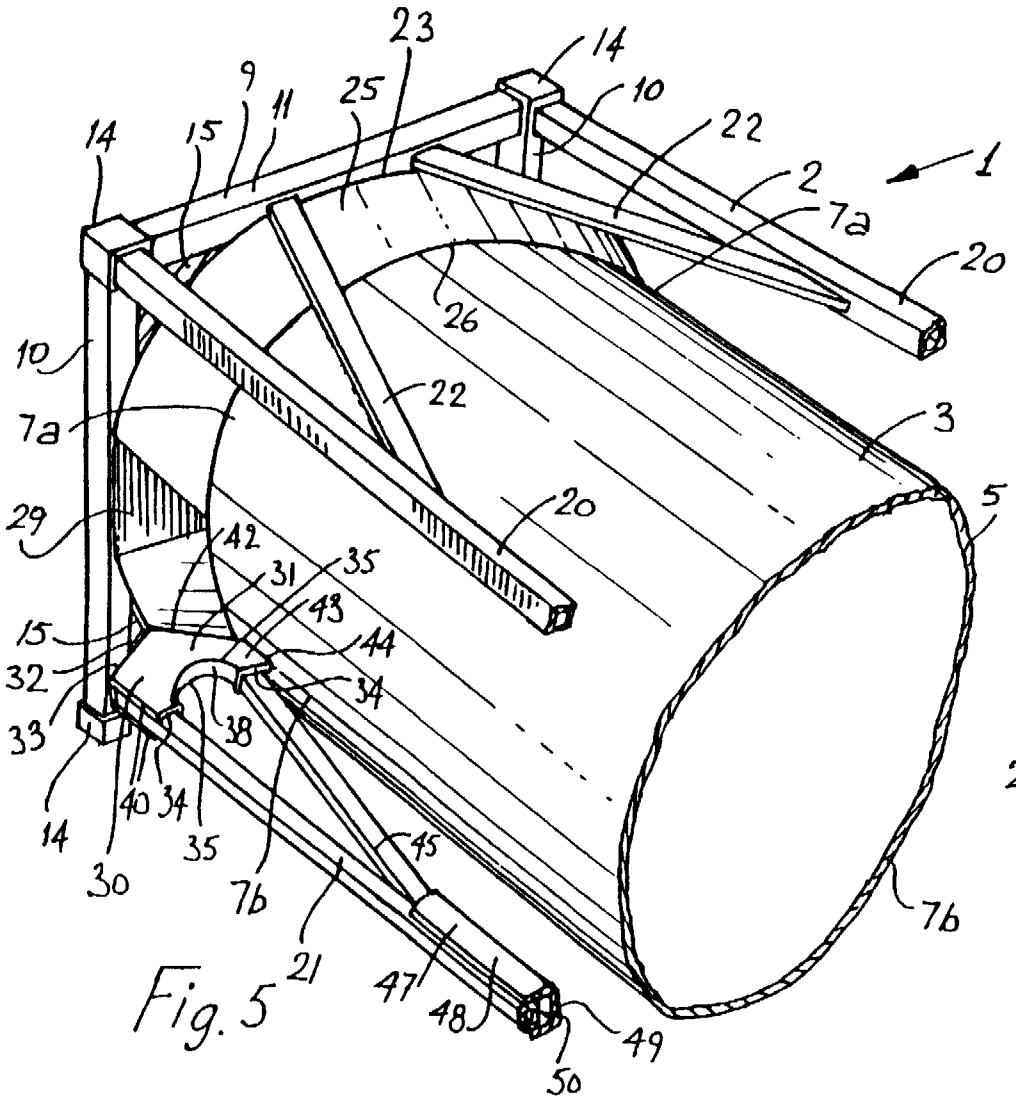
Figure 4:
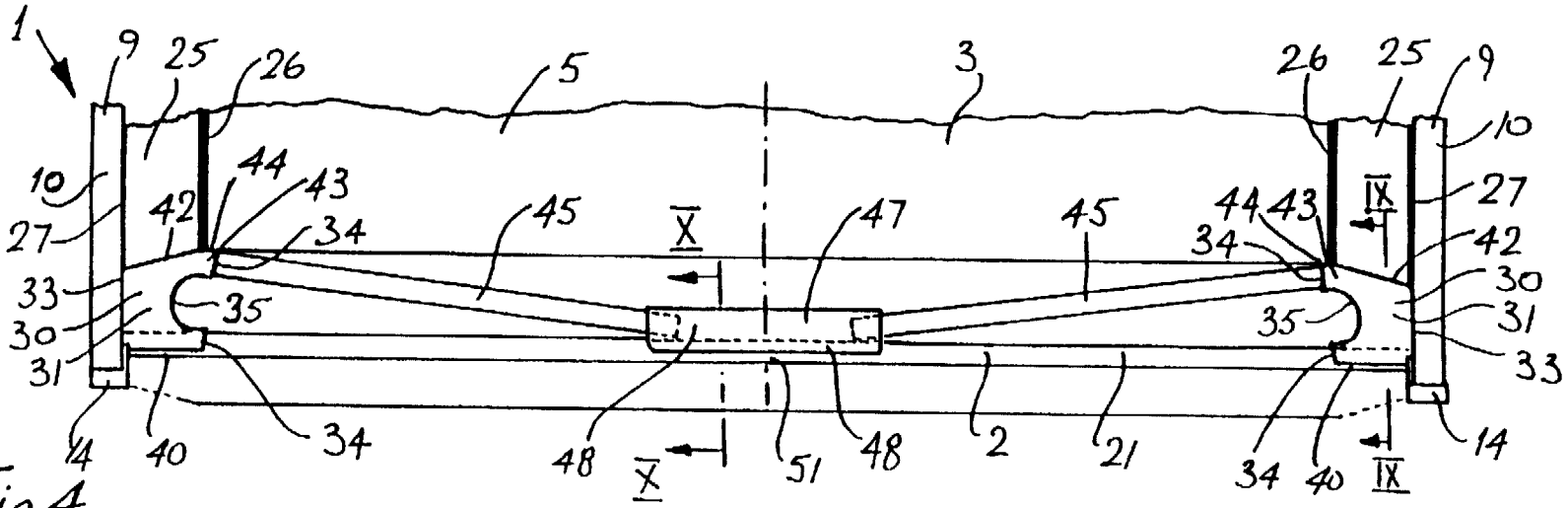
Figure 3:
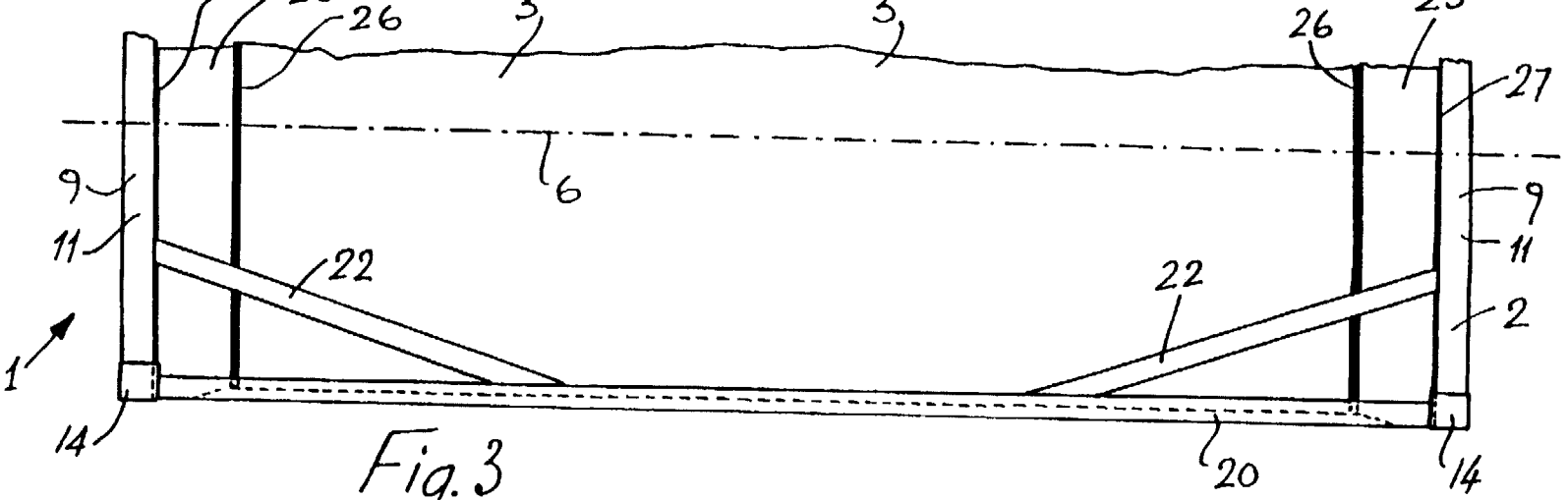
Figure 6:
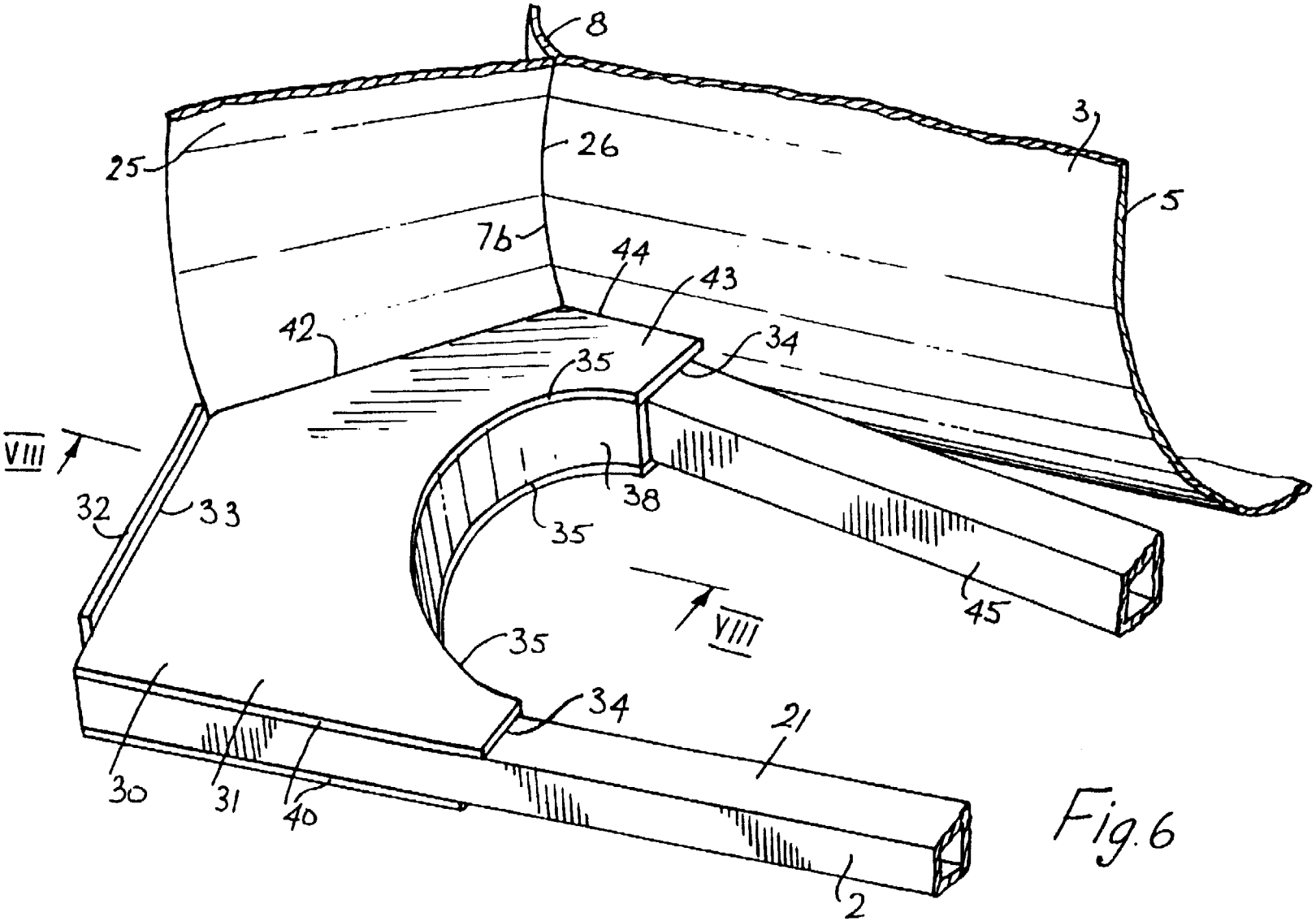
Figure 7:
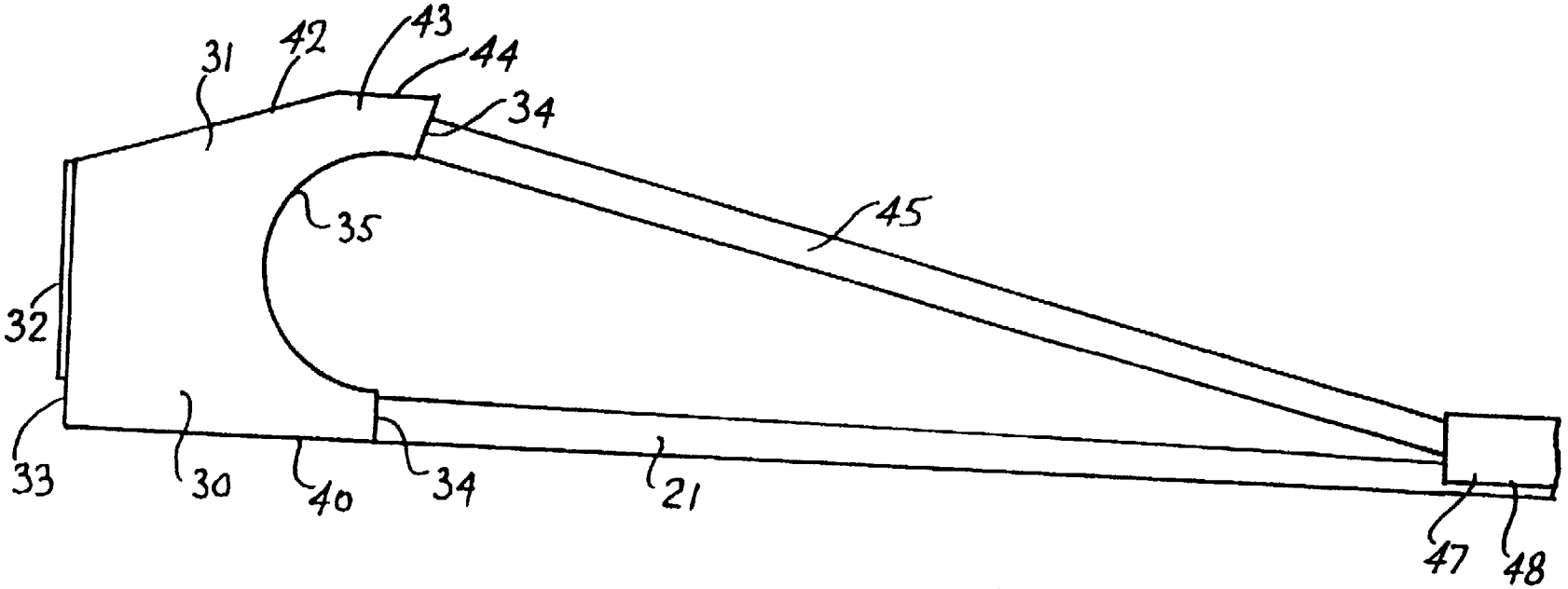
Figure 9:
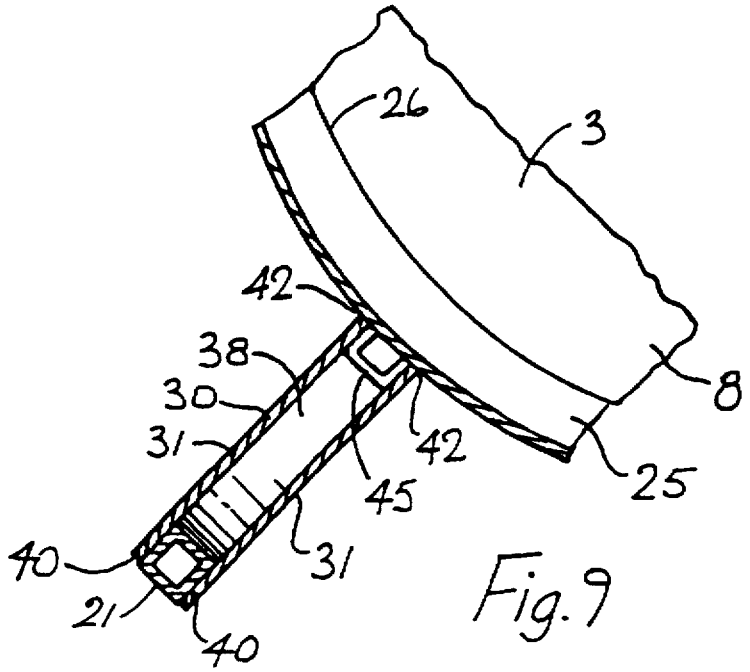
Figure 8:
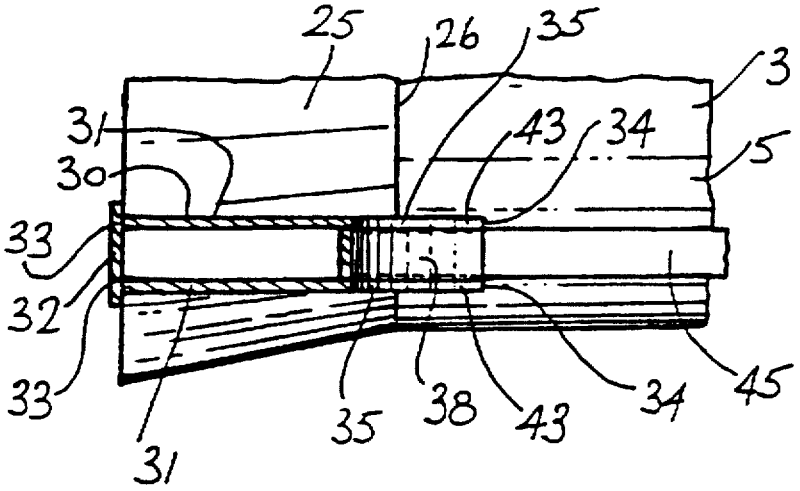
Figure 10:
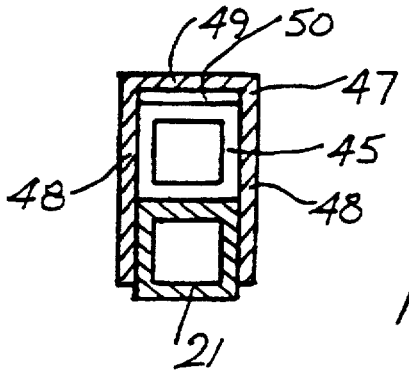

The invention will be more clearly understood from the following description of a preferred embodiment thereof, which is given by way of example only, with reference to the accompanying drawings in which:

FIG. 1 is a side elevational view of a container tank according to the invention, FIG. 2 is an end elevational view of the container tank of FIG. 1, FIG. 3 is a top plan view of portion of the container tank of FIG. 1, FIG. 4 is a true plan view of portion of the container tank of FIG. 1 viewed in the direction of the arrow A of FIG. 2, FIG. 5 is a perspective view of portion of the container tank of FIG. 1, FIG. 6 is a perspective view of a detail of the container tank of FIG. 1, FIG. 7 is a true plan view of the detail of FIG. 6 in the direction of the arrow A of FIG. 2, FIG. 8 is a cross sectional view of the detail of FIG. 6 on the line VIII—VIII of FIG. 6, FIG. 9 is a cross sectional view of the detail of FIG. 6 on the line IX—IX of FIG. 4, and FIG. 10 is a cross sectional view of another detail of the container tank of FIG. 1 on the line X—X of FIG. 4.

Referring to the drawings, there is illustrated a container tank according to the invention indicated generally by the reference numeral 1. The container tank 1 in this case is of the frame tank type and is particularly suitable for the transportation of liquids, gas and other materials with fluid like characteristics. The container tank 1 comprises a framework 2 and an elongated tank 3 for the liquid located within and mounted to the framework 2. The tank 3 may be of steel, stainless steel or any other suitable material depending on the contents to be carried in the tank 3. The tank 3 comprises an elongated central cylindrical shell 5 which defines a longitudinally extending central axis 6, and four quadrants 7, namely, two upper quadrants 7*a* and two lower quadrants 7*b*. A pair of end caps 8 seam welded to the cylindrical shell 5 close the ends of the shell 5. The thickness of the material of the shell 5 and end caps 8 will be determined largely by the material from which the tank 3 is constructed, and also by the type of liquid or other materials to be transported in the tank 3. Hand and manholes covered by lids, as well as inlet and outlet pipes and valves, are provided to the tank 3, but are not illustrated. The provision of such details in tanks of container tanks will be well known to those skilled in the art.

The framework 2 comprises a pair of end frames 9 which extend transversely of the central axis 6 at the respective ends of the tank 3. The end frames 9 comprise a pair of upright side members 10 joined by top and bottom cross members 11 and 12, respectively. The side, top and bottom cross members 10, 11 and 12, are of box section steel, in this case, the side members 10 are of 150 mm by 150 mm external transverse cross section. The top cross members 11 are of 100 mm by 100 mm external transverse cross section. The bottom cross members 12 are of 150 mm by 100 mm external transverse cross section. The side, top and bottom cross members 10, 11 and 12, respectively, are joined together by four corner castings 14 of the type manufactured to ISO standards which will be well known to those skilled in the art, and which are suitable for securely engaging the container tank 1 on a truck flat, stacking a plurality of container tanks one on top of the other, and for connection to a lifting frame of a hoist and the like. The corner castings 14 are welded to the side, top and bottom cross members 10, 11 and 12, respectively. Two upper and two lower connecting struts 15 also of box section steel 150 mm by 100 mm external transverse cross section extend between and are welded to the side members 10 and the respective top and bottom cross members 11 and 12. The end frames 9 are joined by a pair of parallel upper longitudinal members 20 and a pair of lower longitudinal members 21 both of box section steel of 100 mm by 100 mm external transverse cross section. The upper longitudinal members 20 extend between the respective opposite upper corners of the end frames 9 and are welded to the upper corner castings 14. Strengthening members 22 of box section steel of 100 mm by 50 mm external transverse cross section extend from the top cross member 11 of each end frame 9 to the upper longitudinal members 20. The lower longitudinal members 21 are welded to the side members 10 adjacent the lower corner castings 14, and the lower longitudinal members 21 are angled as will be described below. Before describing the lower longitudinal members 21 in further detail, the mounting of the tank 3 in the framework 2 will first be described.

A mounting means for mounting each end of the tank 3 to the adjacent end frame 9 comprises a bearer plate 25 of steel plate material of 3 mm thickness. Each bearer plate 25 is located at its corresponding end of the tank 3 and extends to the adjacent end frame 9. In this example, each bearer plate 25 is of fusto-conical shape, and extends completely around the corresponding end of the tank 3, and defines an axis of generation which co-incides with the central axis 6 of the central shell 5 of the tank 3. Each bearer plate 25 is seam welded to the central shell 5 of the tank 3 adjacent the corresponding end cap 8 along a continuous seam weld 26. The curvature of each bearer plate 25 at the seam weld 26 is substantially similar to the curvature of the central shell 5 along the seam weld 26. In other words, the diameter of the bearer plates 25 where they join the central shell 5 of the tank 3 is substantially similar to the diameter of the central shell 5. Each bearer plate 25 diverges from the tank 3 to the adjacent end frame 9. The bearer plates 25 are seam welded to the side members 10 and the top and bottom cross members 11 and 12, respectively, and to the connecting struts 15 by continuous seam welds 27. Portions 29 of the bearer plates 25 are flattened at each side of the container tank 1 adjacent the side members 10 to avoid the bearer plates 25 extending on either side of the container tank 1 beyond the side members 10.

Four reinforcing plate members 30 are located adjacent the lower corners of the end frames 9 and extend between and are secured to the adjacent lower longitudinal member 21 and the bearer plate 25 adjacent the lower quadrants 7*b* of the tank 3 for strengthening the framework 2 and more rigidly securing the tank 3 in the framework 2. In this way, the tank 3 forms a load bearing structural member of the framework 2, thereby enabling a reduction in the load carrying and bearing capacities, and in turn, the weight of the upper and lower longitudinal members 20 and 21. Each reinforcing plate member 30 comprises a pair of parallel spaced apart identical reinforcing plates 31 of steel plate material of 2 mm thick which extend over and sandwich the adjacent lower longitudinal member 21 therebetween. Each reinforcing plate member 30 comprises a mounting plate 32 of steel plate material of 8 mm thickness which extends along and joins adjacent outer end edges 33 of the reinforcing plates 31. The mounting plate 32 is seam welded to the reinforcing plates 31 along the outer end edges 33. The mounting plate 32 and outer end edges 33 of the reinforcing plates 31 are welded to the side members 10 and connecting struts 15 of the adjacent end frame 9. Inner end edges 34 of the reinforcing plates 31 are formed with an arcuate peripheral edge portion 35 which defines a recess which is slightly greater than a semi-circular recess. An arcuate connecting plate 38 of steel plate material of 8 mm thickness extends between the arcuate edges 35 of the reinforcing plates 31, and is seam welded along the arcuate edges 35 to the respective reinforcing plates 31. Outer side edges 40 of the pairs of reinforcing plates 31 of each reinforcing plate member 30 extend on respective opposite sides of the adjacent lower longitudinal member 21 and are seam welded thereto, thereby sandwiching the lower longitudinal member 21 between the reinforcing plates 31. Inner side edges 42 of the reinforcing plates 31 are continuously seam welded to the adjacent portion of the bearer plate 25. A portion 43 of each reinforcing plate 31 extends beyond the adjacent bearer plate 25, and extends along the shell 5 of the tank 3 and is seam welded to the tank 3 along a seam weld 44.

Four reinforcing struts 45 extend from the respective reinforcing plate members 30 from the portions 43 which are located adjacent the tank 3 and thus are spaced apart from the lower longitudinal members 21. Each reinforcing strut 45 extends from its adjacent reinforcing plate member 30 towards the adjacent longitudinal member 21, and is secured thereto by an elongated U-shaped connecting member 47. The end of each reinforcing strut 45 adjacent the reinforcing plate member 30 is sandwiched between the reinforcing plates 31 and is welded to the portions 43. The radius and the shape of the arcuate edges 35 of the reinforcing plates 31 is such that the lower longitudinal member 21 and the reinforcing strut 45 extend from each reinforcing plate member 30 substantially tangentially to the arcuate edges 35 of the reinforcing plates 31. By virtue of the fact that each reinforcing strut 45 converges towards the adjacent lower longitudinal member 21, the curvature of the arcuate edges 35 is such that the arcuate edges 35 define a recess which is just more than a semi-circle so that both the reinforcing strut 45 and the lower longitudinal member 21 extend tangentially from the arcuate edges 35. By virtue of the fact that the reinforcing plates 31 are seam welded to the mounting plate 32, the connecting plate 38, the lower longitudinal member 21, the reinforcing strut 45 and are seam welded along the bearer plate 25 and portion of the shell 5 of the tank 3, the space between the reinforcing plates 31 is substantially sealed.

The connecting members 47 comprise a pair of side webs 48 extending from a main transverse web 49. The side webs 48 are seam welded to the lower longitudinal members 21 and define with the lower longitudinal member 21 and the main web 49 an elongated bore 50 within which the two reinforcing struts 45 extend. The reinforcing struts 45 join the lower longitudinal members 21 at a position just short of the midway position 51 between the ends of the lower longitudinal members 21, and the positions at which two reinforcing struts 45 join their adjacent longitudinal member 21 are equi-spaced on either side of the midway position of the lower longitudinal member 21. The reinforcing struts 45 are securely welded to the lower longitudinal members 21 and to the connecting members 47.

The reinforcing plate members 30 each define a central plane 52 which extends midway between the reinforcing plates 31 and parallel to the reinforcing plates 31. The two reinforcing plate members 30 on the same side of the container tank 1 share a common central plane 52. Each central plane 52 contains the central axis 6 and extends from the central axis 6 at an angle of approximately 45° to the vertical, see FIG. 2. Each lower longitudinal member 21 is angled, and its corresponding reinforcing struts 45 are also angled to co-incide with the central plane 52 of the corresponding reinforcing plate members 30.

In use, the container tank 1 with the tank 3 full or empty is transported by road, rail, sea or air. The container tank 1 is placed on a truck flat or other platform or support with the lower corner castings 14 of the end frames 9 resting on the truck, platform or indeed on the upper corner castings of a lower container tank or other container.

While the container tank has been described as being provided with upper longitudinal members joining the end frames, the upper longitudinal members may in certain cases be dispensed with. It is also envisaged in certain cases that the reinforcing struts may be omitted, and where reinforcing struts are provided, other suitable means for joining the reinforcing struts to the lower longitudinal members may be provided besides the U-shaped connecting member, indeed, the connecting members may be dispensed with. While the reinforcing plate members have been described as comprising pairs of reinforcing plates, in certain cases, it is envisaged that each reinforcing plate member may comprise only one single reinforcing plate.

While a particular construction of end frame and tank has been described, other constructions may be provided. Indeed, it will be appreciated that it is not necessary for the central shell of the tank to be cylindrical, it may be of any other cross section, for example, ovoid, elliptical or the like. In general, it is envisaged that the curvature of the bearer plates adjacent the tank would be such as to follow the curvature of the tank.

Needless to say, it will be appreciated that bearer plates of construction and shape other than those described may be provided. Indeed, it will be appreciated that it is not essential for the bearer plates to be of fusto-conical shape, and it is also not essential that the bearer plates be flattened on opposite sides of the container tank. Further, it will be appreciated that instead of providing a single bearer plate at each end of the tank, the bearer plate may be provided in a number of segments which would be separated from each other extending from the end of the tanks to the end frames. For example, a pair of bearer plates may be provided at each end of the tank, one bearer plate would be almost semi-circular and extend from the top of the tank to the end frame, while the other would likewise be almost semi-circular and would extend from the bottom portion of the tank to the end frame. It is also envisaged that in certain cases the bearer plate may only extend from the lower quadrants of the tank to the end frame adjacent the reinforcing plate members, and in certain cases, two bearer plates may be provided, one associated with a corresponding reinforcing plate member. In such cases, other suitable mounting means besides bearer plates may be provided at the upper portion of the tank.

While the upper and lower longitudinal members and the reinforcing struts have been described as being of box section steel, they may be of any other cross section, and of any other suitable material. For example, they may be of circular cross section, channel cross section, I-cross section, T-cross section, angle cross section or the like. Where they are of circular cross section they may be of solid or hollow section. Additionally, the cross section of these members may be different. Needless to say, the above cross sections are given by way of example only, and many other cross sections may be used. The material of the upper and lower longitudinal members and reinforcing struts may be aluminium, stainless steel, alloy or the like. Additionally, it will be appreciated that the material of the bearer plates and reinforcing plates, the mounting plates and the connecting plate may be of any other suitable material besides steel, for example, aluminium, stainless steel, or alloy.

It will also be appreciated that the end frames may be of any other suitable material besides steel, and the side, top and bottom cross members may be of any other suitable or desired section besides box section.

I claim:

1. A container tank (1) comprising an elongated tank (3) defining a longitudinally extending central axis (6), and defining four quadrants (7) in transverse cross section, namely, a pair of upper quadrants (7*a*) and a pair of lower quadrants (7*b*), the tank (3) being disposed between a pair of spaced apart end frames (9), having opposite lower corners, extending transversely of the central axis (6) at respective opposite ends of the tank (3), the end frames (9) being joined by a pair of spaced apart parallel lower longitudinal members (21) extending from positions adjacent respective opposite lower corners (14) of the end frames (9), and a mounting means (25) at each end of the tank (3) for mounting the tank (3) to the adjacent end frame (9), each mounting means (25) comprising at least one bearer plate (25) extending from the tank (3) adjacent the lower quadrants (7*b*) thereof to the adjacent end frame (9), and each bearer plate (25) being secured directly to the tank (3) and directly to the adjacent end frame (9), characterised in that four reinforcing plate members (30) are located adjacent the four respective lower corners (14) of the end frames, each reinforcing plate member (30) extending between and being secured to the adjacent lower longitudinal member (21) and the bearer plate (25).

2. A container tank as claimed in claim 1 characterised in that each reinforcing plate member (30) is secured to the adjacent end frame (9).

3. A container tank as claimed in claim 1 or 2 characterised in that each reinforcing plate member (30) extends from the adjacent bearer plate (25) and is secured to an adjacent portion of the tank (3).

4. A container tank as claimed in claim 1 characterised in that an elongated reinforcing strut (45) is secured to each reinforcing plate member (30) at a position adjacent the bearer plate (25) and spaced apart from the lower longitudinal member (21), each reinforcing strut (45) extending from the adjacent reinforcing plate member (30) towards the adjacent lower longitudinal member (21) and being secured to the lower longitudinal member (21) at a position spaced apart from the adjacent reinforcing plate member (30).

5. A container tank as claimed in claim 4 characterised in that each reinforcing plate member (30) defines a central plane (52) parallel to the reinforcing plates (31), the central plane (52) containing the central axis (6) of the tank (3).

6. A container tank as claimed in claim 5 characterised in that the central plane (52) of each reinforcing plate member (30) extends downwardly from the central axis (6) of the tank (3) at an angle to the vertical in the range of 30° to 60°.

7. A container tank as claimed in claim 6 characterised in that the central plane (52) of each reinforcing plate member (30) extends downwardly from the central axis (6) of the tank (3) at an angle to the vertical of approximately 45°.

8. A container tank as claimed claim 5 characterised in that the lower longitudinal member (21) and the reinforcing strut (45) adjacent each reinforcing plate member (30) lie in the central plane (52) of the reinforcing plate member (30).

9. A container tank as claimed in claim 4 characterised in that the two reinforcing struts (45) adjacent each lower longitudinal member (21) are secured to the lower longitudinal member (21) at spaced apart locations short of the midway position (51) between the respective ends of the lower longitudinal member (21).

10. A container tank as claimed in claim 9 characterised in that the two respective reinforcing struts (45) are secured to the lower longitudinal member (21) at locations equispaced on opposite sides of the midway position (51).

11. A container as claimed in claim 9 characterised in that the two reinforcing struts (45) adjacent each lower longitudinal member (21) are secured to the lower longitudinal member (21) by an elongated connecting member (47) of U-shaped cross section, the connecting member (47) having a pair of spaced apart side webs (48) extending from a main transverse web (49), the side webs (48) being secured to the lower longitudinal member (21) and defining with the main web (49) and the lower longitudinal member (21) an elongated bore (50) for receiving the respective reinforcing struts (45).

12. A container tank as claimed in claim 4 characterised in that a portion (35) of a peripheral edge (34) of each reinforcing plate member (30) intermediate the adjacent lower longitudinal member (21) and the reinforcing strut (45) defines an arcuate recess, the adjacent lower longitudinal member (21) and reinforcing strut (45) extending from the reinforcing plate member (30) tangentially to the arcuate peripheral edge portion (35).

13. A container tank as claimed in claim 1 characterised in that each reinforcing plate member (30) comprises a pair of spaced apart parallel reinforcing plates (31), the reinforcing plates (31) of each reinforcing plate member (30) being secured to opposite sides of the adjacent lower longitudinal member (21).

14. A container tank as claimed in claim 1 characterised in that each reinforcing plate (31) is provided with an arcuate peripheral edge portion (35) intermediate the adjacent lower longitudinal member (21) and the adjacent reinforcing strut (45).

15. A container tank as claimed in claim 14 characterised in that an arcuate connecting plate (38) extends between the reinforcing plates (31) of each reinforcing plate member (30) adjacent the arcuate peripheral edge portions (35) of the respective reinforcing plates (31), the connecting plate (38) co-inciding with the arcuate peripheral edge portions (35).

16. A container tank as claimed in claim 1 characterised in that the tank (3) comprises an elongated central shell (5) defining the central axis (6), the ends of the central shell (5) being closed by a pair of transversely extending end caps (8), each bearer plate (25) extending from the central shell (5) of the tank (3) adjacent the adjacent end cap (8) thereof.

17. A container tank as claimed in claim 1 characterised in that each bearer plate (25) is an arcuate bearer plate (25), and each bearer plate (25) defines an axis of generation extending generally parallel to the central axis (6) of the tank (3).

18. A container tank as claimed in claim 17 characterised in that each bearer plate (25) is formed by portion of a conical wall (25) which diverges away from the tank (3).

19. A container tank as claimed in claim 17 characterised in that the bearer plate (25) at each end of the tank (3) extends completely around the tank (3) and defines an axis of generation co-inciding with the central axis (6) of the tank (3) and the curvature of each bearer plate (25) adjacent the tank (3) co-incides with the curvature of the central shell (5) of the tank (3).

* * * * *